United States Patent [19]

Markham

[11] 3,965,826

[45] June 29, 1976

[54] SHELVING STRUCTURE

[75] Inventor: Robert D. Markham, Peoria, Ill.

[73] Assignee: H C Products Co., Princeville, Ill.

[22] Filed: May 5, 1975

[21] Appl. No.: 574,566

[52] U.S. Cl. ..... 108/152; 108/108; 211/187; 248/243

[51] Int. Cl.[2] ..... A47B 5/00

[58] Field of Search ..... 108/108, 109, 152; 211/148, 153, 176; 248/243

[56] References Cited

UNITED STATES PATENTS

| | | | |
|---|---|---|---|
| 2,653,783 | 9/1953 | Lindsay | 248/243 |
| 3,088,424 | 5/1963 | Knuth | 108/108 |
| 3,186,668 | 6/1965 | Story | 211/148 X |
| 3,465,895 | 9/1969 | Miller | 211/176 |

*Primary Examiner*—James C. Mitchell
*Attorney, Agent, or Firm*—McCaleb, Lucas & Brugman

[57] ABSTRACT

A wall mounted metal shelf assembly utilizing parallel spaced upright wall mounted channel brackets having spaced slotted openings for connective reception of projecting tongue portions of cantilever off-wall brackets and metal shelf members overcovering and undersupported by the cantilever brackets; the openings in the wall brackets being formed to include detent portions engageable with the tongue portions of the cantilever brackets to effectively lock the same against lateral shifting in their mounted condition and the shelf members having portions which cooperatively interlock with the cantilever brackets and resiliently engage the wall brackets to positively stabilize the assembly.

6 Claims, 9 Drawing Figures

SHELVING STRUCTURE

This invention relates generally to off-wall mounted shelving structure and more particularly, to improved means for interlocking and stabilizing cantilever supported metal shelving.

Display and storage shelving utilizing wall mounted channel support members formed with vertically spaced slotted openings for receiving interlocking tongue portions of cantilever support brackets are well known and familiarly employed for storing or displaying various articles such as books, foodstuffs, general merchandise, and the like. In general this class of shelving is desirable because of its flexibility in mounting the shelving at selected elevations and the convenience of quick and simple assembly. However, since the cantilever brackets are usually maintained in the wall bracket slots by gravity and shelf load, their mounted stability is not always the best, particularly when the shelving is in an unloaded condition. Consequently, it is frequently possible to accidentally disconnect the assembly components by simply bumping the shelving sufficiently to partially or completely disconnect one or more of the cantilever brackets from its support.

In brief, therefore, this invention is directed to improvements in the familiar cantilever, off-wall bracket, shelf supporting assemblies of the above generally described category which includes novel means for positively interconnecting the components thereof and leads to improved unloaded stability of the assembly.

It is an important object of this invention to provide an improved off-wall, cantilever supported shelving structure having means for positively interlocking readily detachable components thereof.

Another important object of this invention is to provide an improved metal shelving structure as aforesaid in which the wall mounted brackets, cantilever shelf brackets and shelf members cooperatively interlock to provide a statically stable assembly.

A still further object of this invention is to provide improved means for interlocking cantilever shelf brackets with wall mounted channel brackets to prevent accidental shifting movements of the cantilever brackets.

A still further object of this invention is to provide an improved shelving structure employing cantilever shelf supporting brackets detachably interconnected with wall mounted brackets in which metal shelf members are securely interlocked with such brackets to prevent their accidental disassociation.

Having thus described the present invention, the above and further objects, features and advantages thereof will be recognized by those familiar with this art from the following detailed description of preferred and modified embodiments thereof illustrated in the accompanying drawings and representing the best mode presently contemplated so as to enable those familiar with the art to practice this invention.

Figure 1:
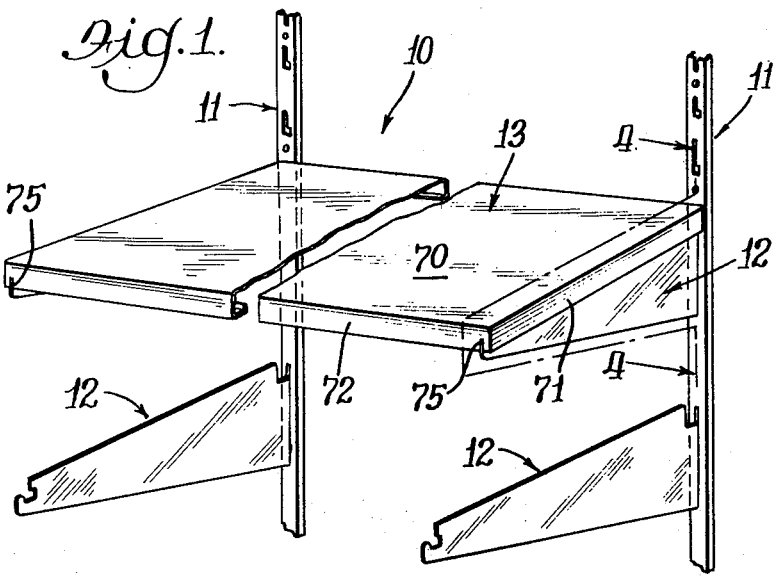
FIG. 1 is a perspective view illustrating an improved wall-mounted shelf assembly according to this invention.

Turning now to the specific features of the first form of this invention illustrated in FIGS. 1 through 4 of the drawings, it will be recognized from FIG. 1 in particular that the shelving structure assembly, indicated generally at 10 in that Figure, comprises a pair of laterally spaced and vertically or upright disposed wall brackets 11, 11, having one or more pairs of right angularly related cantilever shelf brackets 12, 12 supported thereon for undersupporting horizontal metal shelf members 13. These general components of the assembly are typically arranged to accommodate one or more shelf members at selected elevations in accordance with the adjustable locations of cooperating pairs of the cantilever shelf brackets 12 on the wall brackets. All components of the above generally described shelving structure are preferably of rigid material, such as aluminum or steel, suitably formed as by stamping.

Figure 2:
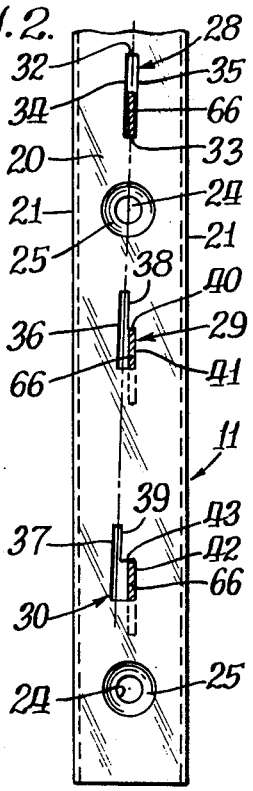
FIG. 2 is a front elevational view of a section of the wall mounted bracket employed in the FIG. 1 assembly.
Figure 4:
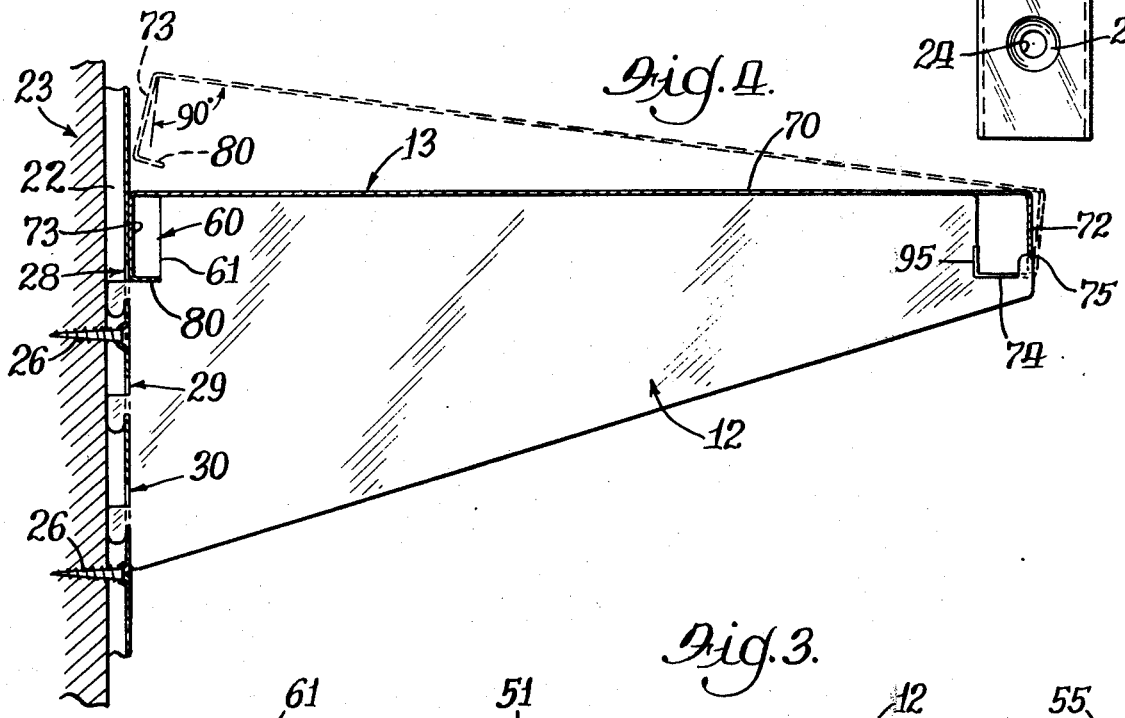
FIG. 4 is a cross sectional view taken substantially along vantage line 4—4 of FIG. 1 and looking in the direction of the arrows thereon.

As best shown in FIGS. 2 and 4, each wall bracket 11 constitutes a selected sectional length of channel formed metal having a substantially U-shaped cross sectional configuration to provide a mounting platform portion or front wall 20 and two inwardly depending, laterally spaced side wall flange portions 21, 21 extending at right angles to the plane of the platform portion 20, and at the lateral margins of the latter. The U-shaped formation provides a chambering or space 22 (see FIG. 4) between the platform portion 20 and the supporting wall 23 in the mounted condition of the wall brackets. To this end, the platform portion 20 of each wall bracket is provided with a plurality of spaced mounting openings 24, 24, disposed at selected axially spaced positions along the length of the bracket. Each such opening is suitably formed to include a frustoconical rim 25 to underengage and recessingly receive the head end of an attachment screw means 26, or the like, employed for securing the channel formed wall brackets to the wall 23. A typical installation for two brackets 11 is illustrated best in FIG. 1 of the drawings showing a cooperating pair thereof in parallel, laterally spaced upright condition on wall 23.

In addition to the screw receiving openings 24, the platform portion 20 is provided with one or more series of three spaced slotted openings 28, 29 and 30 located at selected intervals along the length of the platform portion and arranged in cooperating groupings. Each group of three slotted openings accommodates the interconnective reception of a single cantilever bracket 12 as will hereinafter be described.

It is to be noted that each opening 28 is generally parallelogram in shape having parallel top and bottom edges 32, 33 normal to the longitudinal axis of the bracket 11, and parallel spaced side edges 34 and 35 which intersect the longitudinal center line of the platform wall 20 (see FIG. 2).

The openings 29 and 30 are key-hole shaped and may be characterized as generally reverse L-shaped in formation, having top and bottom edges paralleling the corresponding edges 32 and 33 of opening 28 and one lateral side edge 36 and 37, respectively, which is coplanar with the one side edge 34 of opening 28. Edges 36 and 37 of openings 29 and 30 are paralleled by a laterally spaced opposing side edge portion 38 and 39, respectively, extending from the upper end of such openings partially along the right hand margin thereof as viewed in FIG. 2. Edge 38 of opening 29 intersects a detent shoulder formed by a transversely and downwardly sloping edge 40 extending from the upper end of a right hand edge portion 41 disposed parallel to the longitudinal axis of the platform wall 20.

In a similar fashion, the opening 30 includes the right side edge portion 39 paralleling the left edge 37 thereof and a secondary right hand edge 42 which parallels the longitudinal axis of the platform portion 20, such edge portions 39 and 42 being interconnected by an angularly disposed detent shoulder edge 43.

In general, it will be understood that the lower right hand edge portions 41 and 42 of the openings 29 and 30, respectively, parallel the longitudinal axis of the platform wall 20 while the left hand edges 36 and 37 thereof, as well as the respectively parallel related upper right hand edge portions 38 and 39 intersect the longitudinal axis of the platform wall 20. The detent shoulder edges 40 and 43 of openings 29 and 30, respectively, are raked at an angle extending downwardly from the outer edge portions 41 and 42, respectively, to effect a detent means as will appear presently. It further is to be noted that the lowermost opening 30, while shaped like the intermediate opening 29, is in fact larger than the latter, while the vertical dimensions of the three openings 28, 29 and 30 are alike.

Figure 3:
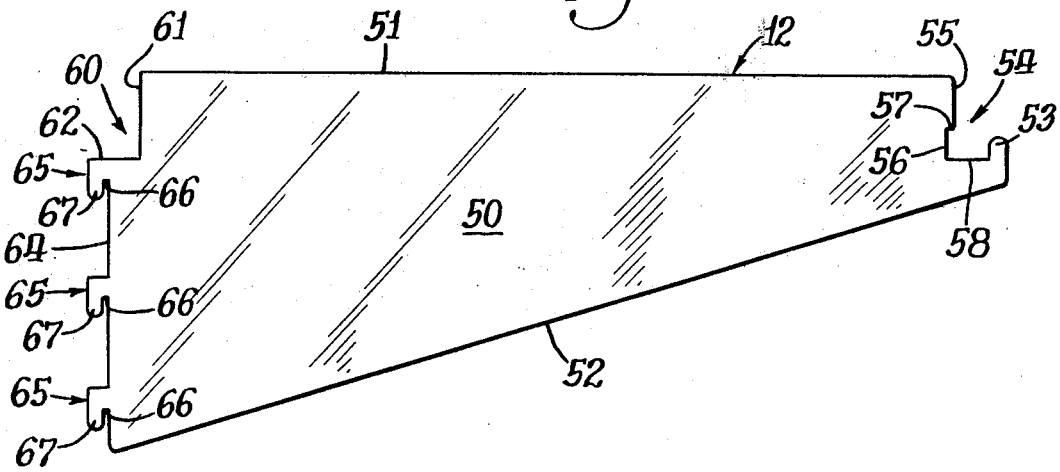
FIG. 3 is a side elevational view of the cantilever shelf bracket employed therein.

Turning now to the features of the cantilever support brackets 12 employed with the upright wall brackets 11, special reference is made to FIGS. 2, 3 and 4 of the drawings from which it will be recognized that each bracket 12 is formed as a substantially trapezoidal shaped metal member having a planar body 50 formed with an operationally disposed horizontal upper edge 51 and an angularly disposed lower edge 52. The outer or right hand end of the body 50 is distinguished by upwardly projecting hook portion 53 and a detent socket or recess, indicated at 54, and which interlockingly cooperates with the metal shelf member 13 in assembly, as will be described in greater detail hereinafter. Basically the socket 54 is located between the hook portion 53 and the upper edge 51 of the body and includes parallel end edges 55 and 56 aligned at right angles to edge 51 and interjoined intermediate their ends by a transverse shoulder 57 paralleled by a bottom wall 58.

The opposite base or inner end of the body 50 is configured to include a rectangular cutout portion 60 at the upper corner thereof, formed by right angularly intersecting edge portions 61 and 62; edge 61 intersecting the upper edge 51 of the body at right angles. The inner end 64 of the body is further formed with three vertically spaced locking tabs or tongues 65 extending outwardly of the edge 64 and each including a reduced throat section 66 intermediate the edge 64 of the body and a downwardly extending locking ear portion 67 thereof. As will be recognized from FIG. 4, in particular, the several tongues 65 of the cantilever support bracket 12 interfit with the slotted openings 28 through 30 of the wall bracket to interconnect the latter and the cantilever bracket so that the latter projects in cantilever fashion at right angles to the supporting wall bracket 11 in assembly.

The specific mode of interlocking the tongues 65 of each bracket 12 with their respective set of slotted openings in the wall bracket is best depicted in FIG. 2 of the drawings. As there shown the several throat portions 66 of the locking tongues 65 are designed to snap beneath the detent shoulder edges 40 and 43 of the intermediate and bottom openings 29 and 30 to positively interlock the two brackets, particularly against lateral and vertical movements. More specifically, it will be understood that the elongated portions of the three openings 28, 29 and 30 accommodate the insertion of the tongue 65 in a slanted or canted condition with respect to the longitudinal axis of the wall bracket 11. Thus to effect interconnection the three tongues 65 of each cantilever bracket are inserted through the platform wall 20 of the mounting bracket following which the bracket 12 is slipped downwardly until the lower edges of the throat sections 66 engage the bottom wall or edge of each of the openings 28–30. The entire bracket 12 is then pivoted laterally about its upper tongue 65 to a vertical upright position on the center line of the platform wall 20 causing the throat section 66 of the intermediate and lowermost tongues to snap beneath or past the detent shoulders of the intermediate and bottom openings 29 and 30 as depicted in FIG. 2 of the drawings. Meanwhile the throat section 66 of the uppermost tongue is likewise moved within the slanted opening 28 to a vertical position symmetrically of the longitudinal center line for the platform wall 20 as shown; the lateral dimension of the opening 28 being sufficient to accommodate such pivoting activity. In this manner then the cantilever bracket is securely interlocked with the wall bracket with the detent shoulder portions or edges 40, 43 of the openings 29 and 30 operatively holding the same against accidental or unwanted lateral movement.

While the above described interlocked relationship between the wall and shelf supporting brackets renders such sub-combination generally stable, in order to further enhance the stability of their assembly and the shelf member 13 supported thereby, the latter is effectively formed to operatively interlock with both the wall and cantilever shelf supporting bracket, as will now be described. With specific reference to FIGS. 1 and 4 of the drawings, it will be recognized that the shelf member comprises generally planar rectangular upper supporting wall 70 which is bordered on marginal edges by downwardly turned planar flange portions comprising end flange portions 71, 71, a front flange portion 72 and a rear flange portion 73 (see FIG. 4). The front and rear flange portions 72 and 73 in particular are each formed to interlock with the outer ends of the cantilever support bracket 12 and the wall brackets 11, respectively.

With particular reference to the FIG. 4 showing, the front edge or outer flange portion 72 of the shelf member is turned downwardly along the frontal margin of the planar support wall 70 at right angles to the latter and the lower portion thereof is bent inwardly at right angles to form a bottom flange portion 74 and upwardly turned lip portion 75 paralleling flange portion 72. Correspondingly the bottom flange portion 74 parallels the planar support wall 70 of the shelf member.

It will be recalled that cantilever bracket 12 is provided with a recess or cut-out 54 at its outer end which is distinguished by an insert shoulder edge 57. Such shoulder 57 is adapted to engage the extreme outer end of the upturned lip portion 75 in assembly with the shelf member as best shown in FIG. 4 of the drawing. This arrangement effectively holds the lip portions 75 under the shoulder 57 and interlocks the shelf member with the cantilever bracket.

The flange portion 73 provided along the inner or rear marginal edge of the shelf wall 70 is, similar to the configuration of the flange portion 72 above described, provided with a bottom flange portion 80 as indicated as best shown in FIG. 4. In contrast the formation of the forward edge flange portion 72, the rearward edge flange portion 73 is formed or bent at an angle greater than 90° relative to such upper wall 70 as indicated in dotted lines in FIG. 4. In assembly, the rear flange 73 of the shelf member is pushed downwardly into socket 60 forcing or springing the flange portion 73 into a right angle relation with wall 70. The inter-engagement of the flange portion 73 with the platform wall 20 of the mounting bracket produces a substantial frictional interlock therebetween to hold the rear margin flange portion 73 in cut-out socket 60. Thus it will be recognized that the inter-frictional engagement of the rear flange portion 73 with brackets 12 coupled with the interlocking lip and shoulder arrangement at the outer end of the cantilever support brackets, provides an effective system for interlocking the shelf member with the assembled wall and cantilever brackets to statically stabilize such assembly and maintain their integrated relationship under normal usage conditions.

Figure 5:
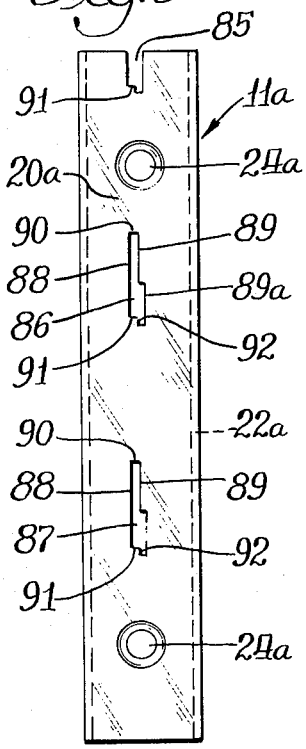
FIG. 5 is a front elevational view of a modified wall mounted bracket section.

Turning now to the features of the modified form of this invention illustrated in FIGS. 5 through 9 of the drawings, it will be recognized that the modified wall bracket 11*a* illustrated in FIG. 5 is identical in all respects to the bracket 11 hereinabove described except for formation of the slotted openings in the platform wall 20*a* theeof. It is further to be noted that in the particular illustration of FIG. 5 a short sectional length of the modified wall bracket 11*a* is illustrated to be used in supporting a single cantilever bracket. Such an installation is used for a closet shelf, for example, where it is desirable to fixedly locate the shelving at a desired height without the capability of vertical adjustment. However, it is to be understood that the modified wall bracket 11*a* also may be made in desired sectional lengths to provide a selective adjustment of cantilever brackets 12*a* thereon at selected positions along its axial length.

The principal advantage provided by the modified wall bracket 11*a* over the first described bracket 11 lies in the uniform formation of the several slotted openings 85, 86 and 87 shown so that any selected three of such openings may be employed to support a single cantilever shelf supporting bracket 12*a*. Be that as it may, in the particular short sectional length illustrated, opening 85 is substantially severed in half while the other two openings 86 and 87 are full sized. As shown, the openings 86 and 87 are identical while opening 85 comprises an identical lower half portion thereof. Thus, description of opening 86 and its formation will suffice for all. Specifically, opening 86 comprises an elongated rectangular slotted opening having parallel opposing side edges 88 and 89 and parallel top and bottom edges 90 and 91, respectively. This portion of opening 86 is offset to the left of the center line of wali 20*a*. The bottom edge 91 is particularly distinguished by a stepped-down configuration to provide a detent shoulder 92. In similar fashion the one side edge 89 thereof has a stepped configuration to include an offset side edge portion 89*a* paralleling the upper side edge portion 89 thereof, forming a secondary shortened slotted opening offset to the right of the elongated portion thereof. In similar fashion the partial opening 85 has a step shoulder 92 as does the next underdisposed opening 87, for purposes which will appear presently.

Other than the above indicated differences, the modified wall bracket 11*a* is identical to bracket 11 previously described and includes parallel lateral or side flange walls 22*a* and fastener receptive openings 24*a* at spaced intervals along its length.

Figure 6:
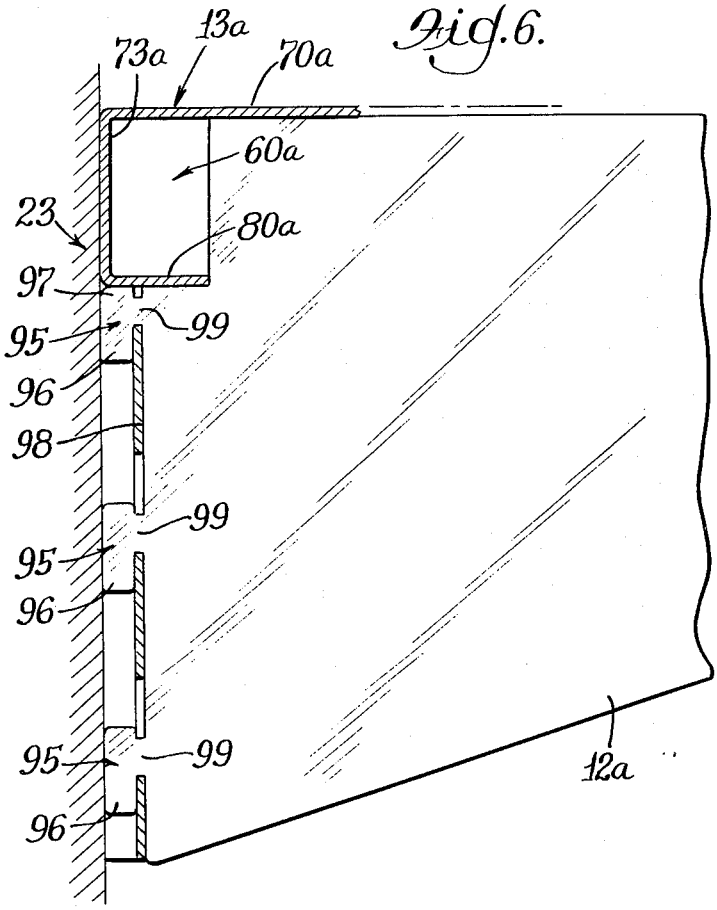
FIG. 6 is a partial side elevational view of cantilever shelf bracket employed with the wall mounted bracket of FIG. 5.

While it is possible to use the cantilever bracket 12 illustrated in FIG. 3 of the drawings with the modified wall bracket 11*a*, it is preferred that the modified form of bracket 12*a* be employed therewith (see FIG. 6). In this respect it will be understood that the bracket 12*a* is formed identically with the first described bracket 12 except for the formation of its locking tongues 95. Specifically, each of the tongues 95 is configured with a generally rectangular-shaped lower ear portion 96 and a shorter upper ear portion 97, spaced from the rear edge 98 of the bracket 12*a* by an intervening rectangular-shaped throat section 99. It is to be noted that the cut-out spaces above and below the throat section are of a width substantially equal to the thickness of the planar wall 20*a* for the wall bracket.

Figure 7:
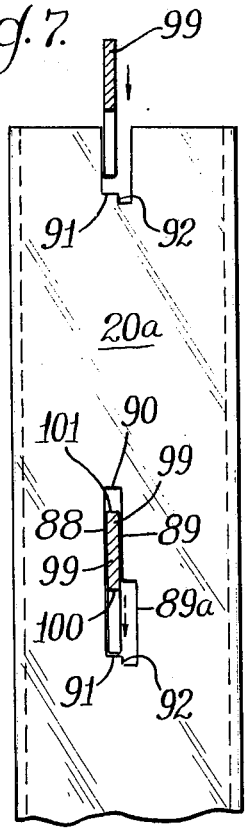
FIGS. 7 through 9 are partial enlarged views in front elevation of the wall mounted bracket of FIG. 5 and demonstrating the procedure of interlocking the cantilever bracket of FIG. 6 therewith.
Figure 8:
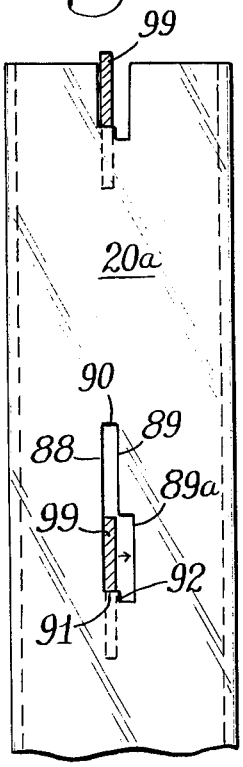
Figure 9:
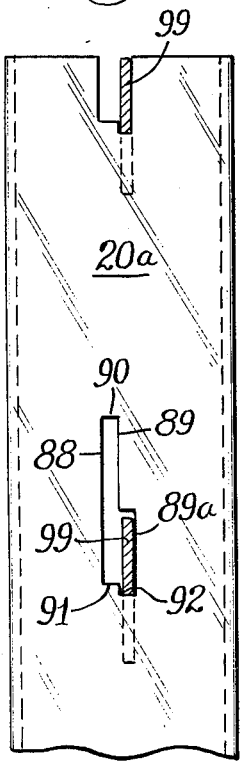

The manner of interlocking the cantilever bracket 12*a* with the wall bracket 11*a* is best shown in the sequential drawings of FIGS. 7 through 9 illustrating interconnection thereof by inserting the tongue portions 95 through the elongated slotted portions of openings 85 through 87, or that is, between the parallel spaced edge portions 88, 89 thereof (see FIG. 7). This maneuver places the tongue portion 95 beyond the rear face of the platform wall 20*a* of the mounting bracket permitting the cantilever bracket to be moved downwardly until the bottom edge 100 of the throat sections 99 engage the bottom edge 91 of each of the openings in a manner shown in FIG. 8. In this position the entire cantilever bracket 12*a* may be shifted bodily in a lateral direction or to the right as viewed in FIGS. 7 and 8 causing the throat sections 99 to enter the offset lower slotted portion of the several openings 85–87 and permitting the same to drop downwardly past the detent shoulders 92 thereof as illustrated in FIG. 9. In this position, bracket 12*a* is effectively prevented from shifting laterally while the tongue portions 95 thereof effectively bridge or extend past the vertical limits of the secondary or shortened portion of the openings 85–87.

Inasmuch as the particular section of illustrated wall bracket 11*a*, as previously noted, is of a length sufficient to accommodate only a single cantilever bracket, slight modification to the shelf member 13*a* is required for its cooperation with the assembled wall and cantilever brackets. This modification basically takes place in the front to back dimension of the upper platform wall 70*a* of the shelf member 13*a* by increasing such dimension sufficiently to permit the rear flange 73*a* thereof to frictionally engage and flex against the surface of the wall 23 as opposed to engagement of flange 73 with platform wall 20 in the above described FIG. 1 assembly. It is also desirable, as illustrated, to increase the dimension of the inwardly turned bottom lip portion 80*a* at the lower end of the flange wall 73*a* so as to closely interfit the rearward marginal edge of the shelf member in the cut-away socket 60*a* (see FIG. 6). It is to be understood, however, that if a greater sectional length of wall bracket 11*a* is employed, so as to permit adjustment of the shelf height by selectively positioning the cantilever bracket in any set of three openings 85–87, as illustrated in FIG. 1, for example, then the shelf member 13 originally described will interfit and cooperate with the wall and cantilever bracket of the modified assembly as initially described hereinabove.

From the above description it is believed that those familiar with this art will readily recognize and appreciate the novel advancement provided by the described embodiments of this invention and will understand that the herein described structure may be modified within the purview of its disclosed concepts without departing from the inventive combination as defined in the hereinafter appended claims.

The embodiments of the invention in which an exclusive property or privilege is claimed are defined as follows:

1. An off-wall shelving structure comprising: an elongated wall bracket mountable in vertical upright position over a supporting wall and including a planar platform portion and a pair of parallel flange portions extending outwardly of the lateral margins of said platform portion to space the latter from said supporting wall, said platform portion having a plurality of uniformly spaced elongated openings therethrough; and a cantilever shelf supporting bracket attachable to said wall bracket comprising a planar body having an operationally disposed horizontal upper edge and a platform engaging rear edge at right angles thereto, a plurality of locking tongues projecting integrally from said rear edge of said body and each having a depending ear portion spaced from said rear edge by an intervening reduced throat section, said tongues being uniformly spaced and formed to enter a selected corresponding plurality of said openings simultaneously whereby to dispose said throat sections thereof within said openings and said ear portions behind said platform portion, said throat sections being laterally movable within said openings with at least one thereof formed to enter a laterally offset portion of its associated opening; and detent means on the periphery of said offset portion for interlocking engagement with said one said throat section whereby to prevent reverse lateral movement thereof and thereby removably lock said cantilever bracket in vertical operating position.

2. The combination of claim 1 wherein said openings are formed with their major axes and at least one elongated edge thereof parallel and in intersecting relation to the central longitudinal axis of said mounting bracket, and said openings associated with at least two of said tongues are generally L-shaped to provide a said offset portion in each thereof which is aligned along said longitudinal axis whereby to accommodate initial insertion of said tongues through and along said major axes of said openings followed by lateral movement to position said throat sections along said longitudinal axis.

3. The combination of claim 1 wherein said detent means comprises a downwardly angled edge of said offset portion formed to interferingly engage the upper edge of a said throat section moved therebeneath.

4. The combination of claim 1 wherein said openings are each uniformly L-shaped in formation having a said off-set portion with detent means in each comprising a shoulder projection in the bottom thereof providing a vertical edge portion interferingly engageable with a lower side margin of a said throat section moved therepast.

5. The combination of claim 1, and a metal shelf member mountable over and undersupported by the upper edges of a pair of cantilever brackets and comprising a planar rectangular shaped horizontally operable support wall having downwardly turned flange walls at the front and rear margins thereof, the said flange wall at said front margin being formed at right angles to the plane of the support wall and integrally joined with an inwardly turned bottom flange portion extending beneath and paralleling said support wall and terminating in an upwardly turned right angularly related lip portion; the flange wall at the rear margin being formed at an obtuse angle with respect to the plane of said support wall; each said cantilever bracket having a cut-away recess at the outer end thereof including a horizontally disposed shoulder detent for overengaging the outer end of said upward turned lip portion whereby to vertically interlock the front margin of the shelf member with the outer ends of said cantilever brackets, and a rectangularly shaped recess formed at the intersection of said upper and rear edges of each said cantilever bracket for inserted reception of the flange wall at the rear margin of said shelf member in assembly, insertion of such rear margin flange wall in said rectangular shaped recess causing the same to interferingly engage the platform portion of a related said mounting bracket to flex the same into right angular relationship with the plane of said support wall and frictionally lock said shelf member in operating position.

6. The combination of claim 5, and a hook portion projecting upwardly into the cut-away recess at the outer end of each said cantilever bracket, and said bottom flange portion at the front margin of said shelf member having a slotted opening therein registeringly receptive of said hook portion to laterally interlock said cantilever bracket and shelf member.

* * * * *